US009121218B1

(12) United States Patent
Ladha et al.

(10) Patent No.: US 9,121,218 B1
(45) Date of Patent: Sep. 1, 2015

(54) GARAGE DOOR DRIP GUARD

(71) Applicants: Riaz Ladha, Markham (CA); Faisal Ladha, Markham (CA)

(72) Inventors: Riaz Ladha, Markham (CA); Faisal Ladha, Markham (CA)

( * ) Notice: Subject to any disclaimer, the term of this patent is extended or adjusted under 35 U.S.C. 154(b) by 0 days.

(21) Appl. No.: 14/554,366

(22) Filed: Nov. 26, 2014

(51) Int. Cl.
*E06B 7/14* (2006.01)

(52) U.S. Cl.
CPC ..... *E06B 7/14* (2013.01)

(58) Field of Classification Search
CPC ..... E05Y 2800/12; E06B 7/14; E06B 7/16; E06B 7/18; E06B 7/20; E06B 9/17046; E06B 2003/7044; E06B 1/522
See application file for complete search history.

(56) References Cited

U.S. PATENT DOCUMENTS

| | | | | |
|---|---|---|---|---|
| 641,139 | A * | 1/1900 | Ogan | 49/314 |
| 5,630,459 | A * | 5/1997 | Martin | 160/236 |
| 6,176,039 | B1 * | 1/2001 | Craig | 49/26 |
| 8,113,265 | B2 * | 2/2012 | Hardison et al. | 160/273.1 |
| 8,627,605 | B2 * | 1/2014 | Drifka | 49/197 |
| 8,769,875 | B1 * | 7/2014 | Scoggins | 49/467 |
| 2011/0283620 | A1 * | 11/2011 | Drifka | 49/70 |
| 2014/0102004 | A1 * | 4/2014 | Drifka | 49/70 |
| 2014/0311039 | A1 * | 10/2014 | Ardaiz | 49/470 |

* cited by examiner

*Primary Examiner* — Katherine Mitchell
*Assistant Examiner* — Scott Denion
(74) *Attorney, Agent, or Firm* — Nasser Ashgriz; UIPATENT Inc.

(57) ABSTRACT

The present invention is a drip guard for garage doors to catch any falling precipitation from the bottom of the garage door. A garage door drip guard assembly comprises of a trough, mounted on an inner surface of a bottom panel of the garage door. The trough having a length equal to the width of the garage door and a diameter to cover underneath the garage door to prevent any dripping. The trough moves under the door when the door is opened and moves away from beneath the door when the door is closed, thus catching falling debris.

13 Claims, 9 Drawing Sheets

GARAGE DOOR DRIP GUARD

FIELD OF THE INVENTION

The present invention relates to devices for preventing precipitation from falling underneath a garage door.

BACKGROUND OF THE INVENTION

Garage doors are commonly formed of a plurality of horizontally elongated sections or panels connected to each other along their horizontal edges through a set of hinges. The door moves from a vertical position when closed to a horizontal position when open. In moving between the vertical and horizontal positions, a gap is formed between the adjacent panels. Such gaps allow rain, snow, dirt and the like to enter into the garage. Also, the accumulated water on the garage door may fall on the people entering or exiting the garage. This kind of dripping may also damage vehicles entering and exiting the garage. Especially, in the winter times, salt may be mixed with the rain or snow, causing more harm if dripped on the people or vehicles. According to these aspects. There is a need for a garage door drip guard to prevent such occurrences.

SUMMARY OF THE INVENTION

The present invention relates to a drip guard for garage doors to catch any dripping precipitation contacting the garage door. A garage door drip guard assembly comprises of a trough, mounted on the inner surface of the bottom panel of the garage door. Said trough is a semi hallow substantially cylindrical shape having a length equal to the width of the garage door and a diameter to cover underneath the standard garage door to prevent any dripping. The trough having means to move under the door when the door is opened and move away from beneath the door when the door is closed.

In the first embodiment of the present device, the means to move the trough is a rod unit mounted on said trough. Said rod unit being attached to the longitudinal edge of the trough and extending beyond the width of the garage door. Said rod having a small roller attached to its free end. A curved ramp is mounted at each end of the garage door frame. The trough and rod assembly are attached to the garage door by a plurality of spring hinges. Said hinges are screwed in at a distance of the bottom part of the garage door from one side, and to the trough from the other side. The trough, rod, hinges and ramp assembly are arranged in such a manner that once the garage door approaches the close position the end of the rod engages with the ramp and stops, causing the trough to rotate from a horizontal position to a vertical position. This causes that the trough is moved away from the beneath the door and also turned to empty its contents. Once the garage door starts to move upward the roller unit is released and the trough rotates forwardly to a horizontal position, standing completely underneath the garage door to prevent any dripping. By closing the garage door, said trough will rotate backwardly and stands in a slight elevation to the ground.

It is the first object of the present invention to provide a garage door, which can be opened and closed without risk of rain water dripping on the people crossing under the door. It is another object of the present invention to prevent vehicles passing under the garage door to get stained by water or salt water dripping on the vehicle. Another object of the present invention is to create a precipitation resistant garage door to prevent rain, snow and dirt flowing into the garage floor, whereby preventing accidents due to fall from slippery surfaces.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF THE DRAWINGS

Figure 1:
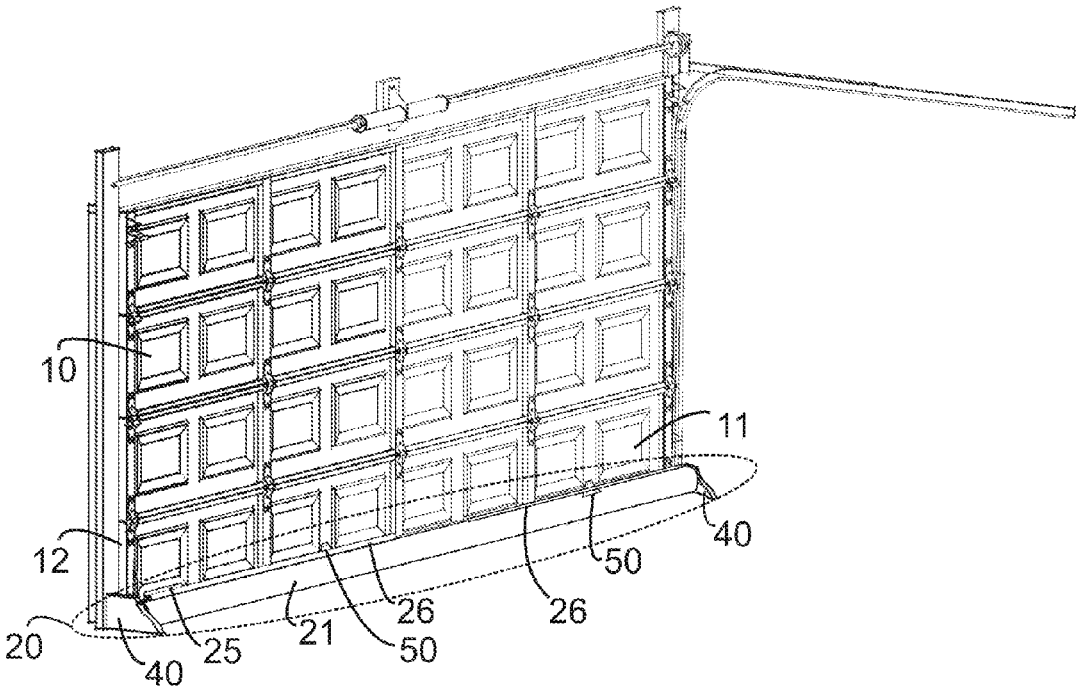
FIG. 1 is a front view of an interior part of a garage door with a preferred embodiment of the present invention, showing the position of the drip guard system when the door is in closed position.

As shown in FIG. 1 a garage door drip guard assembly 20 according to the concepts of the present invention is mounted on the bottom section of a garage door 10. Garage doors in residential housings or any upwardly acting sectional doors are comprised of a plurality of horizontal panels, which are vertically aligned when the door is in the closed position. Adjacent panels are hingely connected to one another to allow the garage door to open and close. As the panels approach the top of garage door frame, they must negotiate a 90 degree turn from a vertical to a horizontal position. During such a turn, an angular gap is formed between the lateral ends of the adjacent panels. The panels are equipped with guard rails which close the angular gap, which can prohibit entry of foreign matters such as snow, dirt, rain drops and the like in between the gaps. Door panels are usually made of expanded plastic foam material such as thermoplastic foam with an outer metal skin or the like to provide protection against the elements. The inner side of the door panel is covered by an expanse of rigid material such as wood to provide a measure of protection. However these protections cannot stop the dripping of snow, dirt and rain drops and the like flowing from the underneath the garage door.

Figure 2:
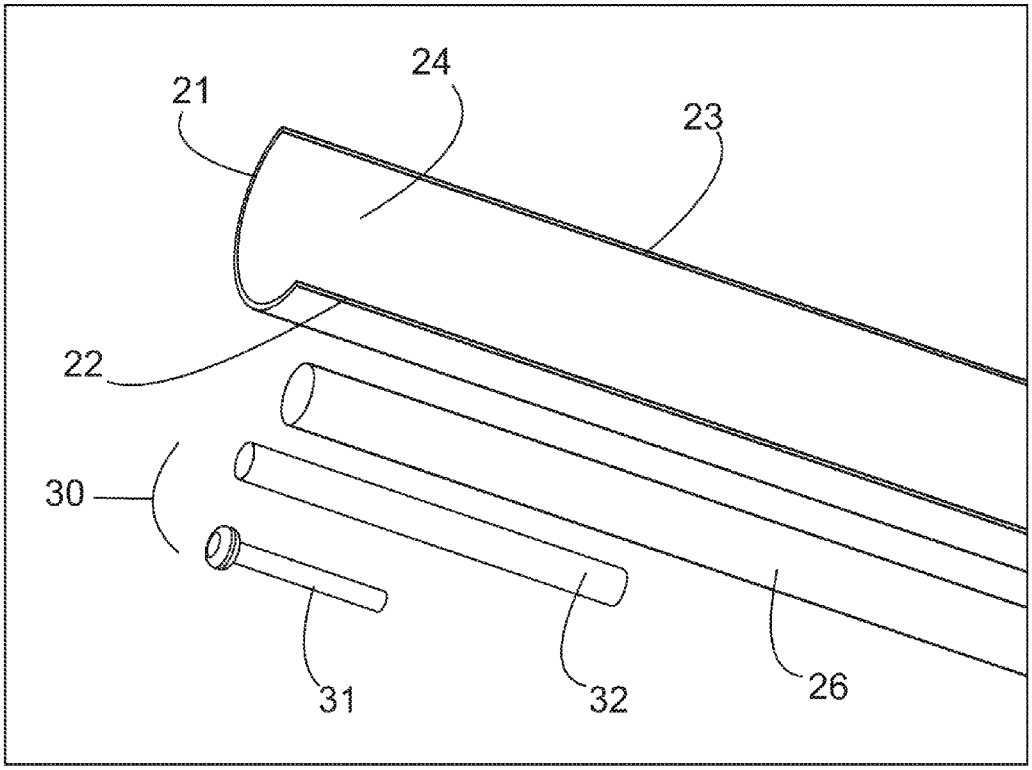
FIG. 2 is an enlarged fragmentary perspective view of the garage door drip guard system.

Referring to FIG. 1 and FIG. 2, a garage door drip guard 20 comprising of a trough 21, which is a substantially semi cylinder member with a length equal to the width of the door 10 and a diameter that can cover underneath of a standard garage door. The trough 21 having an upper longitudinal edge 22 and a lower longitudinal edge 23. The inner space of the trough forms a channel 24 that can collect rain and snow drops. Trough 21 is mounted on the bottom of the first door panel 11, which engages with ground. The two ends of the trough 21 being open to allow the trough to rotate without any contact.

Another possibility for trough 21 is that two ends of said trough 21 being closed to prevent leakage of the contents.

Figure 9:
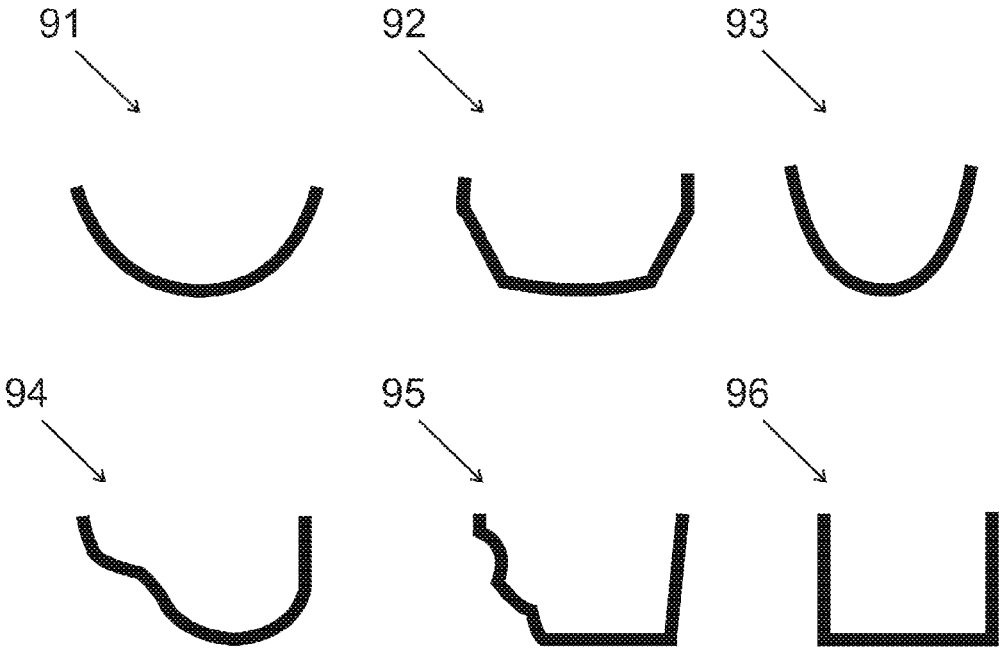
FIG. 9 is a side view of variety shapes of the trough unit.

Trough can be made of any material like plastic, vinyl, aluminum, poly propylene, steel or other suitable materials that are rust proof, lightweight and are protective against oxidation due to water damage. According to FIG. 9 trough unit may have different shapes like half round 91, square 92, polyflow 93, ogee 94, sovereign 95 or rectangular 96. The trough can have any kind of shapes which keep precipitation from falling underneath a garage door.

Figure 3:
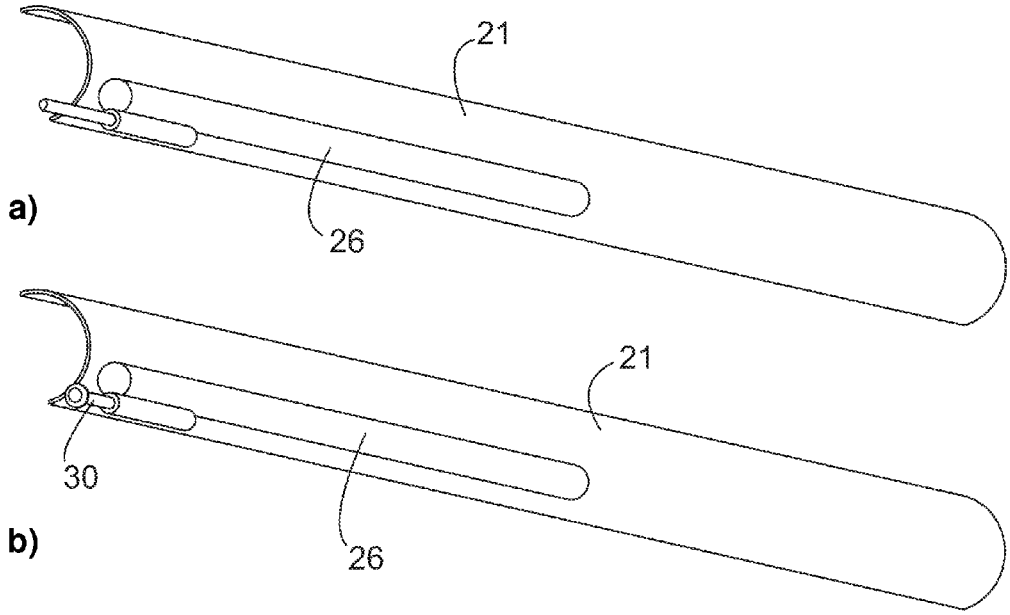
FIG. 3 is a perspective view of the garage door drip guard after assembly.

As shown in FIGS. 1-3, the garage door drip guard 20 further is having a means to lift the trough up when the door closes. In the preferred embodiment, said lift means being a rod unit 26 which is longitudinally attached to the outer surface of the trough and it extends beyond the length of the trough FIG. 3(*a*). As the door closes, the extended part of the rod unit engages with a ramp 40, forcing the trough to turn.

Generally, the rod unit 26 may have any length and any diameter. The rod unit 26 may also be of any desired material like plastic, metal or the like, preferably, although not necessarily, of the same material as the trough unit 21. According to FIG. 3, the rod unit 26 is mounted close to the upper longitudinal edge 22 of the trough 21. The mounting distance of the rod to the upper edge of the trough is designed to lift and rotate the trough from the horizontal to the vertical positions. This distance is preferably one-fourth of the trough diameter. Said rod unit 26 can be mounted on the trough with any means, for instance, it can be glued, screwed, or molded.

In another embodiment of the same device as shown in FIG. 3(*b*), a roller 30 is mounted at the tip of the rod 26 to allow for easy rotation of the trough. The roller may be directly connected to the rod or through another smaller rod. As shown in FIG. 1 and FIG. 2, a roller 30 may have a first part 31 and a second part 32. Said first part 31 is inserted into the second part 32. Said second part 32, is mounted on both ends of the rod unit 26. The first part 31 having a roller unit which stretches out to sit on the ramp 40 when the door 10 is in the closed position.

Figure 4:
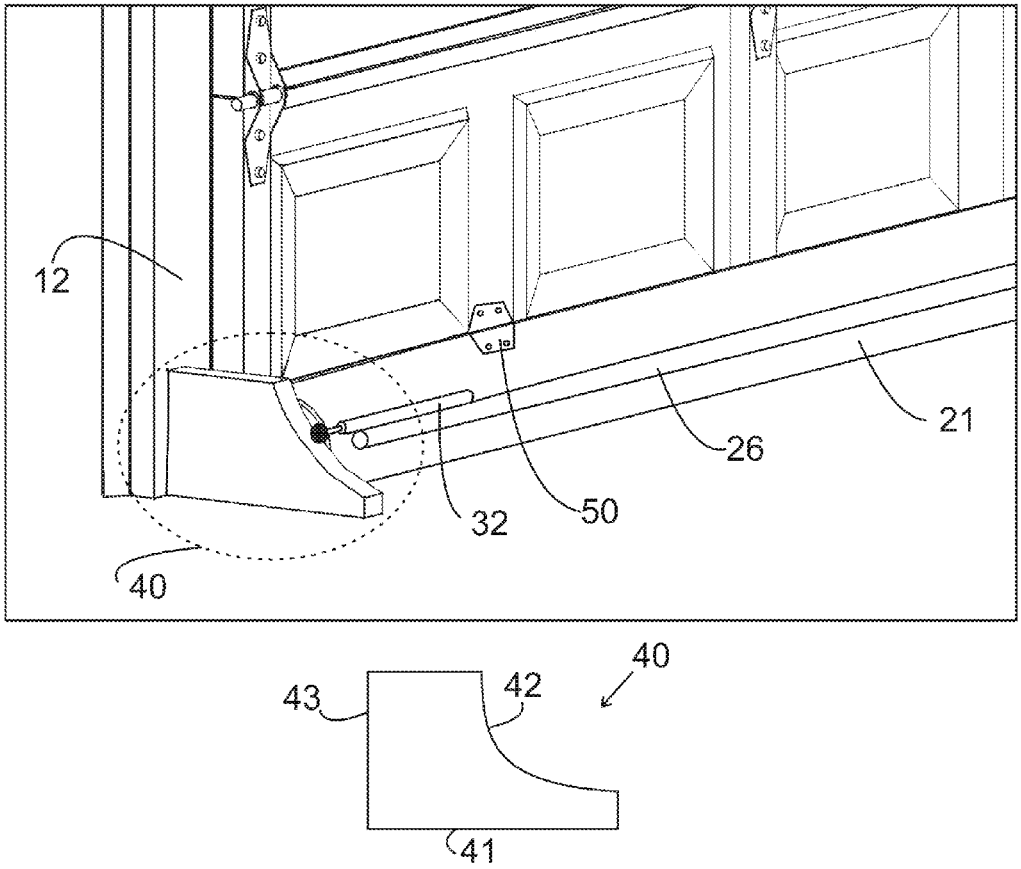
FIG. 4 is an enlarged perspective view of the left side of the garage door drip guard and the position of the roller on the ramp.

As shown in FIG. 1 and FIG. 4, a ramp 40 is mounted at the bottom of the garage door frame 12. The back part 43 of said ramp 40 is attached to the end part of the door frame 12 and the bottom part of said ramp 41 sits on the floor. There are two ramps, one at each end of the garage door frame. Said ramp 40 having an inclined curved surface 42 facing forwardly, a height, and a width proportional to the garage door frame 12. Said ramp 40 engages with the roller unit 30 whenever the garage door 10 moves downwardly. Once the garage door 10 moves downwardly to the closed position, said roller unit 30 engages with the ramp 40, forcing the trough 21 to rotate from the horizontal to the vertical position, subsequently the contents of the trough unit 21 are emptied. The trough unit stands in a higher elevation of the ground. This prevents the device to touch the ground.

Figure 5:
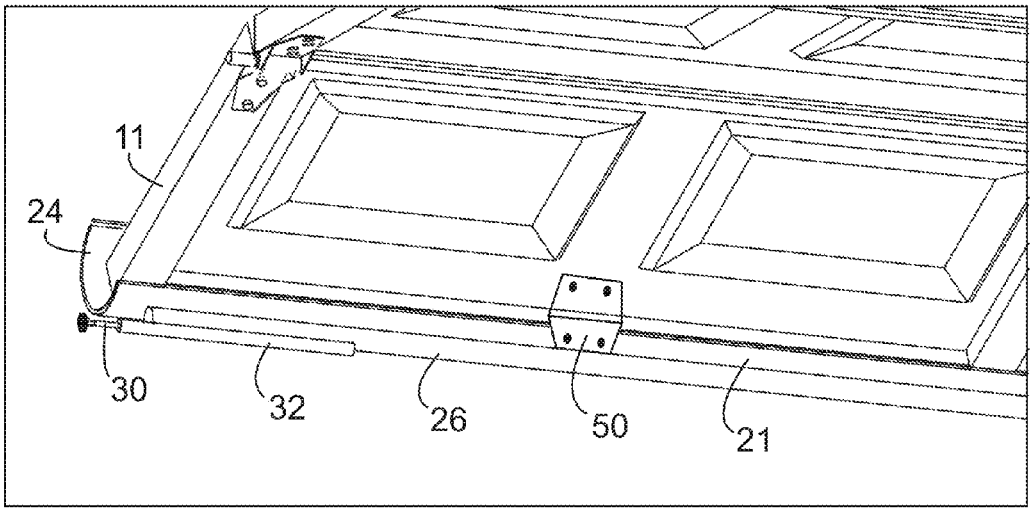
FIG. 5 is a perspective view of the left side of the garage door drip guard showing the position of the device when the door is open.

According to FIGS. 1, 4 and 5, the trough unit 21 is attached to the garage door by plurality of spring hinges 50. Said spring hinges 50 can be of different kinds as known in the art. The hinge leaves is mounted close to the lower edge of the bottom of the garage door panel. The cooperating leaves are then attached to the trough 21 and tightened sufficiently to hold the hinge leaves in the right place. By closing the door the geometry of the hinges insure the trough to rotate backward and stand in a vertical position. When the door starts to move upwardly the geometry of the hinges makes the trough to sit horizontally underneath the garage door.

Figure 6:
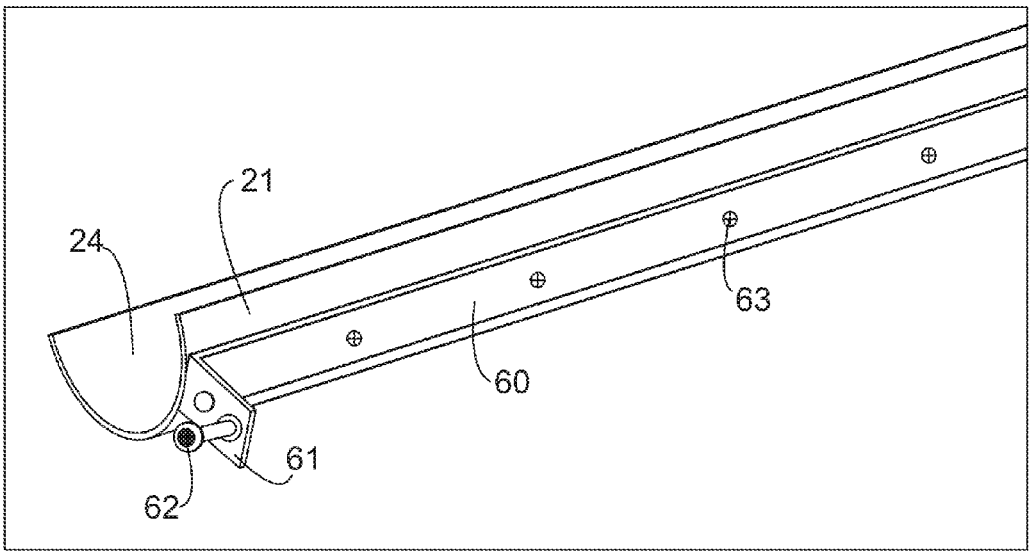
FIG. 6 is a perspective view of another embodiment of the present invention using a metal bar instead of the rod.

FIG. 6 is another embodiment of the present invention, the means to lift the trough being a bent bar, instead of the rod, and a roller attached to the end of the bar. The bent bar 60 is a bar that is bent at one end 61 and it may have a roller member 62 connected directly to its bent end 61. The bar being screwed 63 or adhered directly on the trough, wherein the trough being attached to the garage door by a set of hinges.

Figure 7:
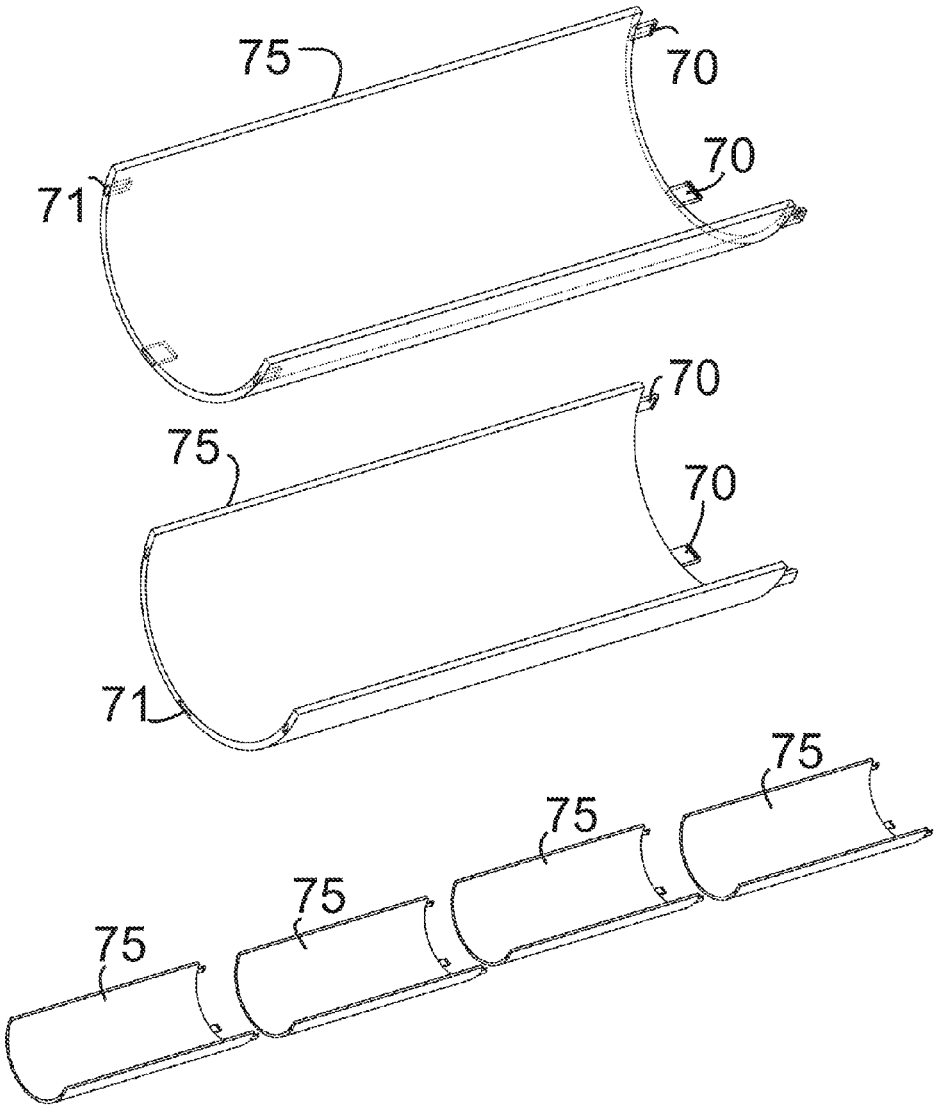
FIG. 7 is a perspective exploded view of another embodiment of the present invention showing the divisible parts.
Figure 8:
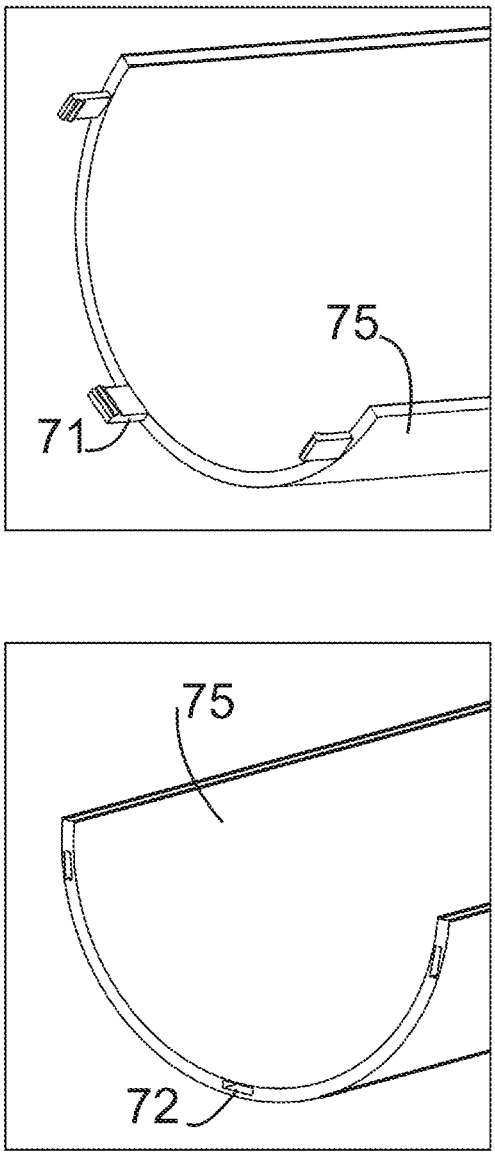
FIG. 8 is an enlarged perspective view of an end portion of a part of FIG. 7 showing the connecting pins and apertures.

FIG. 7 is another embodiment of the present invention, in which the drip guard is divisible into several smaller parts 75, and the parts 75 can be easily connected to each other. Referring to FIG. 7, said trough unit comprises of plurality interlocking parts 75. Each part 75 having plurality of fixing posts 70 at one end, and plurality of receiving apertures 71 on its other end to connect said parts 75 together. The means to attach said parts 75 togethers can be a snap buckles.

In another embodiment of the present invention, the trough unit is a telescopic trough being sized to the garage door. It is to provide a trough adjustable according to the appropriate length of the garage door and being stored in a self-contained kit that enables the unit to be easily stored.

The garage door drip guard may also have a telescopic rod comprising of several parts. Said rod having an end part to attach to the ramp and make the trough to move from the horizontal position to the vertical position once the door is closed. Said trough and rod assembly is mounted then to the door by plurality of hinges.

Another embodiment of the present invention in which the lifting means is being a pair of magnets, one magnet being installed on the bottom part of the garage door frame and another magnet is being installed on both end of the trough, said magnets repel each other once in close vicinity, thereby forcing the trough to lift away from bottom of the garage door.

Another embodiment of the present invention is that a trough can be affixed on a top section of a garage door frame instead of the garage door. The trough has a fixed position on the garage door frame and is equipped with a plurality of hinges. When the garage door is closed, the trough is in a horizontal position against the garage door and when the garage door is open, the garage door moves from vertical position to the horizontal position. After the last part of the garage door moves from vertical to horizontal position, the trough can be placed underneath the garage door and be in a vertical position against the door. The trough is adjustable on the door frame.

In another embodiment of the present invention, by adding a weight to the trough which is attached to the garage door or the door frame, there is no need to have a spring hinge to move the trough in open situation.

The forgoing is considered as illustrative only of the principles of the invention. Further, since numerous modification and changes will readily occur to those skilled in the art, it is not desired to limit the invention to the exact construction an operation shown and described, and accordingly, all suitable modifications and equivalents may be resorted to, filling within the scope of the invention.

With respect to the above description, it is to be realized that the optimum relationship for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by present invention.

What is claimed is:

1. A garage door drip guard configured to be installed on a vertically moving garage door in a garage, wherein said garage door comprises of a plurality of door panels, wherein a first door panel has a longitudinal length and a bottom that engages with a floor when the door is closed, and wherein said garage door has a pair of tracks and wherein a first end of each track of said pair of tracks is connected to the floor, said garage door drip guard comprising:

a. a trough having a length equal to the longitudinal length of the first door panel, an exterior surface and an interior surface, a first end and a second end; and a first and a second longitudinal edge;

b. at least one hinge, wherein said hinge rotatably connects said first edge of said trough to said first door panel, wherein the interior surface of said trough is located under the bottom of said first door panel when the door is open;

c. at least one ramp, wherein said ramp is installed at the first end of one of the tracks of said pair of tracks, and wherein said ramp has a height and a curvature; and d. an extension-rod having a rod-length and rod-angle and is attached by one side of the extension rod to said exterior surface of said trough and extending outwardly towards said ramp, wherein said predetermined rod-length and rod-angle are configured to engage with said ramp as the door approaches the floor and rotatably lift the trough preventing the trough from ever touching the floor when the door closes.

2. The garage door drip guard of claim 1, wherein said extension rod further has a roller to engage with said ramp.

3. The garage door drip guard of claim 1, wherein said trough is any one of half round, square, polyflow, ogee, rectangular or sovereign shapes.

4. The garage door drip guard of claim 1, wherein said trough has a length and a width configured to completely cover the garage door along the entire bottom of said first door panel that engages the floor.

5. The garage door drip guard of claim 1, wherein said trough is comprised of a material that is selected from any one of plastic, polypropylene vinyl, aluminum, or steel.

6. The garage door drip guard of claim 1, further having a support-rod to provide reinforcement to said trough during said lifting.

7. The garage door drip guard of claim 1, wherein said rod further is made of metal or plastic.

8. The garage door drip guard of claim 1, wherein said ramp is selected from the group consisting of wood and metal.

9. The garage door drip guard of claim 1, wherein said hinge is a spring hinges to bring the trough back underneath the door once the door is opened.

10. The garage door drip guard of claim 1, wherein said trough comprises of a plurality of sub-troughs attached to each other.

11. The garage door drip guard of claim 1, further having a pair of ramps, each said ramp is installed at each side of said door.

12. The garage door drip guard of claim 1, further having a reinforcement-rod, said reinforcement-rod is attached to the exterior surface of said trough to provide mechanical support during the lifting of the trough.

13. The garage door drip guard of claim 1, wherein said ramp is a curved ramp for smooth movement of the extension-rod during its engagement with the ramp.

* * * * *